United States Patent [19]

Padilla et al.

[11] 4,104,642

[45] Aug. 1, 1978

[54] T-SHAPED SWIVEL JOINT FOR AN ANTENNA MOUNTING STRUCTURE

[75] Inventors: Gilbert Padilla; Dominick Padilla, both of Bronx, N.Y.

[73] Assignee: RMS Electronics, Inc., Bronx, N.Y.

[21] Appl. No.: 772,285

[22] Filed: Feb. 25, 1977

[51] Int. Cl.[2] ..... H01Q 1/12

[52] U.S. Cl. ..... 343/882; 343/892

[58] Field of Search ..... 343/882, 881, 880, 720, 343/885, 892

[56] References Cited

U.S. PATENT DOCUMENTS

| | | | |
|---|---|---|---|
| 2,680,196 | 6/1954 | Fox et al. | 343/892 |
| 3,514,782 | 5/1970 | Lockwood | 343/882 |

*Primary Examiner*—Alfred E. Smith
*Assistant Examiner*—David K. Moore
*Attorney, Agent, or Firm*—Hubbell, Cohen, Stiefel & Gross

[57] ABSTRACT

In an antenna window mount assembly of the type including a bracing member securable within the frame of a window, and a supporting member securable in outwardly extending relation from the window, an improved T-shaped swivel joint releasably secures the supporting member to the bracing member to permit the supporting member to be moved between the outwardly extended position and a swivel position in which the free end of the supporting member is near the window.

9 Claims, 5 Drawing Figures

FIG. 2.
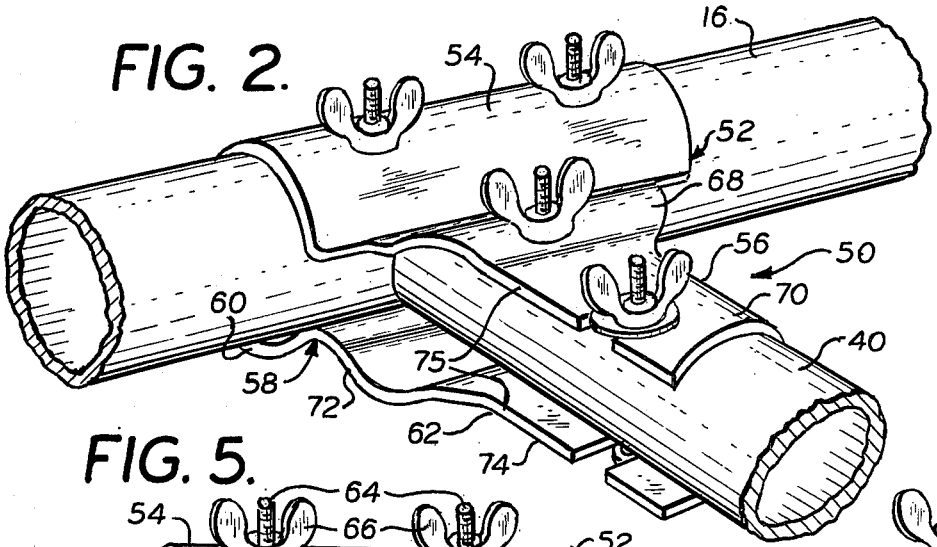
FIG. 5.
FIG. 3.
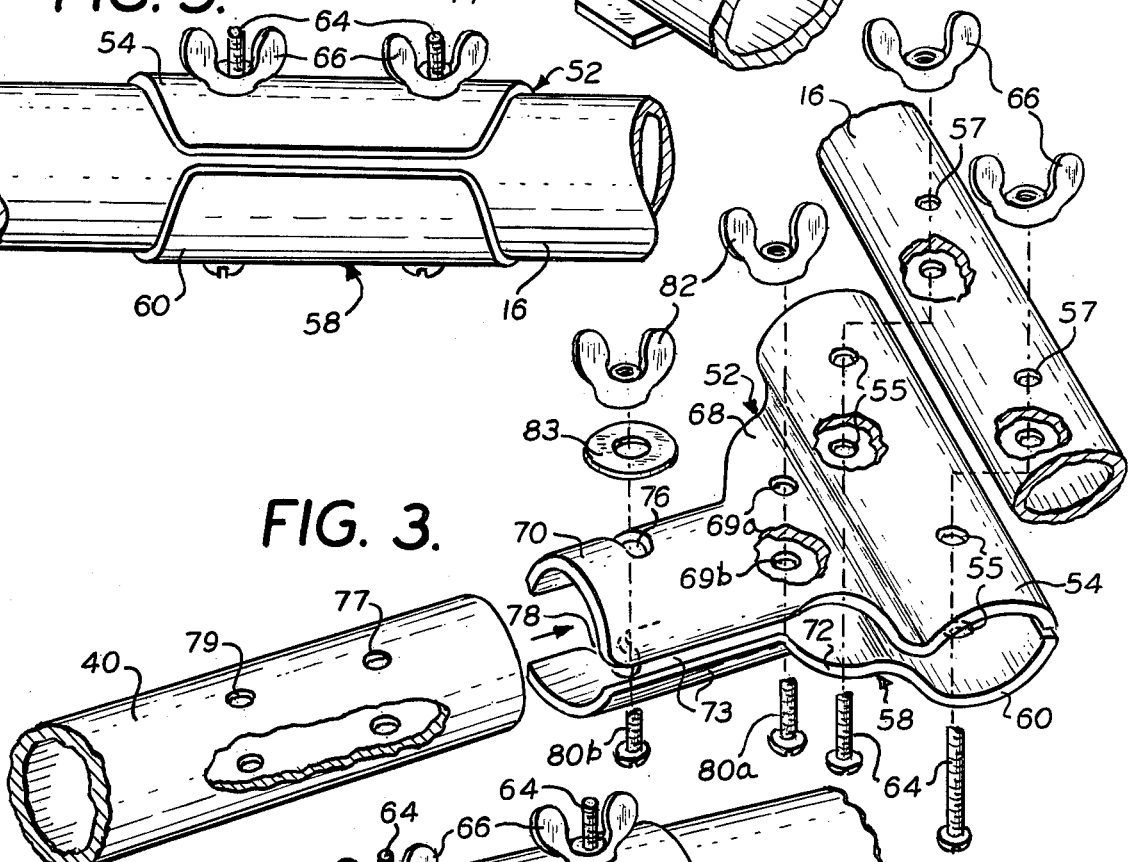
FIG. 4.
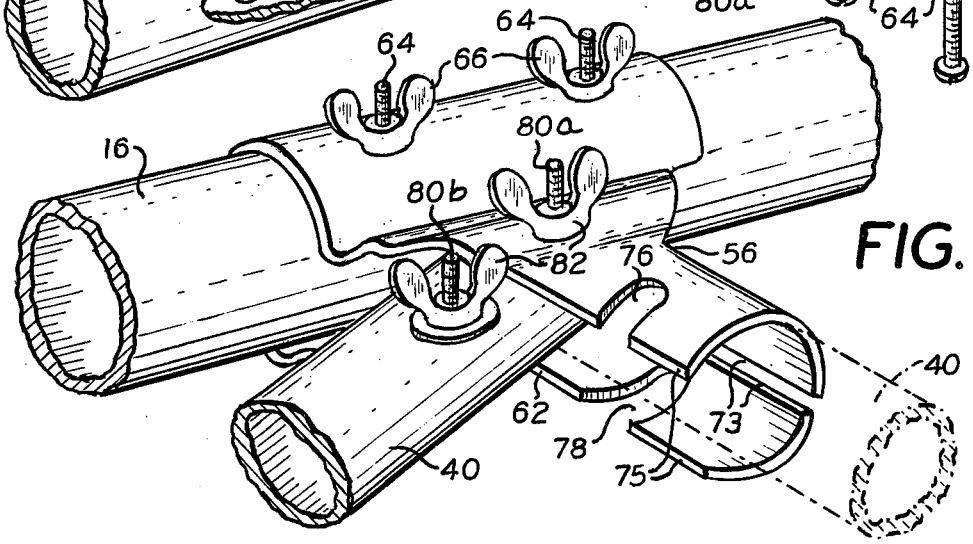

T-SHAPED SWIVEL JOINT FOR AN ANTENNA MOUNTING STRUCTURE

BACKGROUND OF THE INVENTION

1. Field of the Invention

This invention pertains to mounting assemblies for antennas and more particularly to window mount assemblies for antennas. Most particularly, this invention pertains to a joint which securely supports the antenna outwardly from the window and yet permits movement of the antenna toward the window.

2. Prior Art

In commonly assigned U.S. patent application, Ser. No. 746,884 (Morris Hacker and Dominick Padilla, applicants: Title — Window Mount For Vertical CB Antenna; filing date Dec. 2, 1976; art unit 256) a window mount for a vertical CB antenna is disclosed. That antenna mount comprises a bracing member adapted to be secured within the frame of a window and a supporting member securable to the bracing member such that the supporting member is oriented outwardly from the window. The supporting member is part of a boom assembly which includes a mounting plate swivelably secured to the free end of the supporting member. A plurality of angularly oriented ground plane elements extend outwardly from the mounting plate and are swivelable therewith in a horizontal plane. In addition, a vertical CB antenna is removably secured to the plate. The swivelability of the ground plane elements provides the antenna with the capacity for increased directional field strength necessary for effective signal transmission from a window mounted vertical CB antenna.

As disclosed in the aforesaid co-pending application, a U-bolt assembly is employed to secure the bracing member to the supporting member. That assembly is prone to a number of problems including the possiblity of slippage or loosening of the supporting member at the U-bolt juncture. This could result in the supporting member sagging from the desired horizontal orientation, resulting in improper orientation of the antenna. Further, should the supporting member become loosened, the supporting member together with the antenna will flop about in a severe wind condition. While this situation may be somewhat alleviated by further tightening of the U-bolt, severe tightening will only produce further metal fatigue of the bracing member. Eventually, the bracing member will become distorted, and in the extreme situation breakage will take place.

A further disadvantage of the window mount assembly disclosed in that application is that no provision is made for conveniently swiveling the ground plane elements. Thus, depending upon the length of the supporting member the ground plane elements may be 2 or more feet from the window. Adjustment therefore requires the user to lean out of the window. This is dangerous and particularly disadvantageous in that continuous adjustments of the position of the ground plane elements is often required to determine the position in which the antenna has optimum signal transmission strength.

SUMMARY OF THE INVENTION

According to the present invention we have developed a swivel joint for securing one end of the supporting member to the bracing member.

The preferred swivel joint comprises a pair of T-shaped clamps each including a base portion and a protruding portion. The T-shaped clamps are disposed in confronting relation such that the base portions define a first sleeve in which the bracing member is received and the protruding portions define a second sleeve in which the supporting member is receivable. Each of the protruding portions is provided with a hole which holes are registered with a first thru-hole in the supporting member. Each protruding portion is also provided with a slot which extends inwardly from one edge thereof, which slots are registerable with an additional thru-hole in the supporting member.

The joint includes two threaded bolts, one extendable through the first thru-hole in the supporting member and the registered holes in the protruding portions, the other extendable through the second thru-hole and the slots. Wing nuts are also included for engaging the bolts and releasably securing the supporting member between the protruding portions. The slotted set of confronting edges of the protruding portions are spaced such that when the nuts and bolts are loosened the protruding portions may be sufficiently separated whereby the supporting member may be rotated about the first bolt and through the slotted confronting edges to the swivel position. The slots permit the second bolt to be disengaged from the protruding portion as the supporting member is moved to the swivel position. Except for an enlarged space adjacent the first sleeve, the unslotted set of confronting edges of the protruding portions are in relatively close spaced relation as compared with the slotted edges. This provides increased support for the supporting member when the supporting member is in the extended position. The enlarged space is provided to accommodate protrusion of the inward end of the supporting member therethrough when the supporting member is in the swivel position. Lastly, the preferred swivel joint includes means, preferably comprised of additional nuts and bolts, for securing the base portion to the bracing member.

Due to the particular construction of the improved joint according to the present invention, structural support for the supporting member is enhanced. The joint also permits the supporting member to be moved to a position in which the free end of the supporting member is in close spaced relation from the bracing member whereby adjustments may be made at the free end without the necessity of the user leaning out the window. In addition, the joint is inexpensive to manufacture and yet may be readily assembled and disassembled.

Other features and advantages of the improved swivel joint of the invention will appear from the following description and accompanying drawings of a preferred embodiment thereof.

BRIEF DESCRIPTION OF THE DRAWINGS

In the drawings:

FIG. 2 is a perspective view of the preferred swivel joint in accordance with the present invention;

FIG. 3 is an exploded view of the swivel joint as viewed from the right in FIG. 2;

FIG. 4 is a view similar to FIG. 2 showing the supporting member in the swivel position (solid lines) and the extended position (dotted lines); and FIG. 5 is a view in rear elevation of the preferred swivel joint.

DETAILED DESCRIPTION OF THE PREFERRED EMBODIMENT

Figure 1:
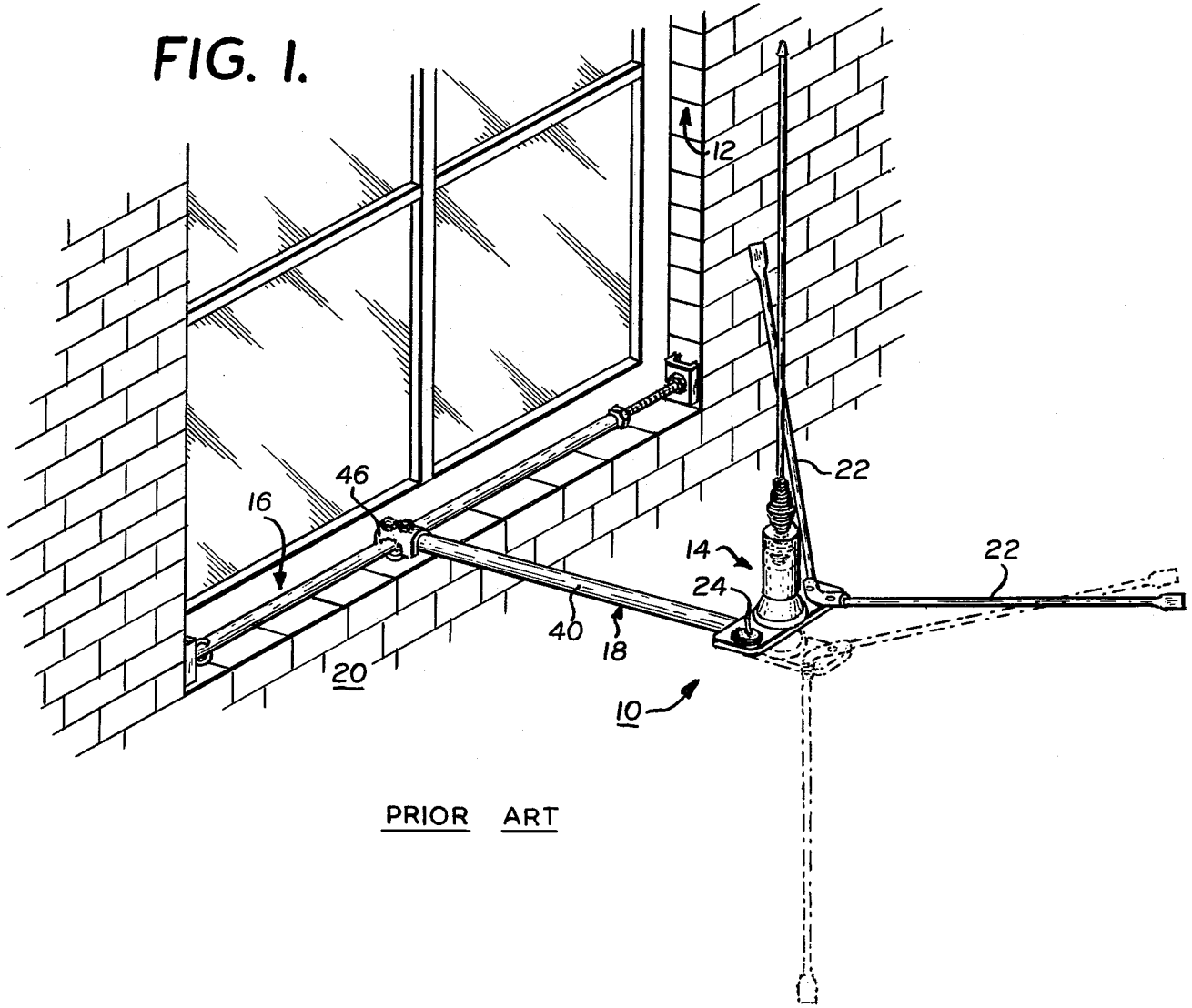
FIG. 1. PRIOR ART
FIG. 1 is a perspective view of a prior art window mount for a vertical CB antenna.

Referring now in detail to FIG. 1, a prior art window mount assembly for a vertical CB antenna, disclosed in said U.S. patent application Ser. No. 746,884, is illustrated. As shown, the assembly 10 is mounted in a window frame 12 and is adapted for use with a conventional vertical CB antenna 14. The assembly 10 includes three principal components, namely a bracing member 16 receivable in the window frame 12, a boom assembly 18 secured to the bracing member 16 and adapted to extend outwardly from the building wall 20, and a plurality of ground plane elements 22 secured in an angularly oriented radial arrangement to the boom assembly 18 which, together with boom assembly 18, define the antenna ground plane. The ground plane elements 22 are swivelable in the horizontal ground plane. The swiveling of the ground plane elements 22 permits the directional strength of the signal transmitted from the antenna 14 to be increased, thereby minimizing the effect of obstructions such as the building wall 20.

The prior art boom assembly 18 includes the supporting member 40 which is secured by a U-bolt 46 to bracing member 16. The U-bolt 46, however, is prone to slippage about the bracing member 16. This problem is accentuated by the weight disposed at the free end of the supporting member by the antenna and the ground plane elements. Moreover, the effective weight on the free end of the supporting member is increased under conditions of rain, high winds, and icing. The effect is a continuous downward force on the free end of the supporting member 40 which tends to rotate the supporting member 40 and U-bolt 46 in a clockwise direction about the bracing member 16. Eventually, due to the construction of the U-bolt 46, some slippage will occur with the result that the antenna 14 will be moved out of the vertical orientation required for most effective signal transmission. Similarly, the ground plane elements 22 and supporting member 40 will also be moved out of their desired orientation. While tightening of the bolts on the U-bolt assembly will tend to reduce slippage, the ultimate effect is metal fatique of the bracing member 16 which could result in the boom assembly together with the antenna and ground plane elements falling to the ground below.

In the prior art assembly disclosed in FIG. 1, the swiveling of ground plane elements 22 requires loosening of the bolt 24. Inasmuch as the distance of the bolt 24 from the window is dependent upon the length of the supporting member 40, and since the supporting member 40 must be at least 2 or 3 feet in length in order for the assembly 10 to be effective, swiveling of the ground plane element 22 requires the user to lean a substantial distance out of the window. The only alternative would be disassembly of the unit each time swiveling of the ground plane elements 22 is effected. This is especially disadvantageous in view of the fact that a number of adjustments may be required before the optimum position is located.

Referring now to FIGS. 2–5, we have developed an improved joint 50 for securing bracing member 16 to supporting member 40 which serves to reduce movement of the member 40 about the bracing member 16 while providing means for allowing the user to swivelingly adjust the position of the ground plane elements at the free end of the supporting member 40 without leaning a dangerously large distance outside of the window. Excepting for the substitution of the joint shown in FIGS. 2–5 the antenna assembly is in all respects the same as that of FIG. 1 and reference may be made to FIG. 1 for parts of our improved assembly not shown in FIGS. 2–5.

The joint 50 includes a T-shaped top clamp 52 comprised of a base portion 54 and a protruding portion 56 and a mirror image T-shaped bottom clamp 58 comprised of a base portion 60 and a protruding portion 62. As shown, the clamps 52, 58 are disposed in confronting relation to define a first sleeve between the base portions 54, 60 in which bracing member 16 is received, and a second sleeve between the protruding portions 56, 62 in which supporting member 40 is receivable. Preferably the top and bottom clamps 52, 58 are constructed of heavy walled aluminum, although other materials which may be employed with equal success will be readily apparent to the skilled art worker. The clamps 52, 58 are preferably made by stamping the clamps from a flat piece of sheet metal though the skilled art worker will immediately recognize that other well known methods may also be used.

As shown, the cross sections of base portions 54, 60 are curved and have internal radii substantially equal to the radius of the bracing member 16 whereby member 16 will be received in close tolerance in the first sleeve when the clamps 52, 58 are disposed as shown in FIG. 1. As presently preferred and shown in FIG. 3, the bight of each base portion 54, 60 has a pair of spaced holes 55 aligned with a pair of thru-holes 57 in the bracing member 16. Threaded bolts 64, and wing nuts 66 are provided for securing the base portions 54, 60 of the clamps 52, 58 to the bracing member 16. Thus, with the bolts 64 extended through the holes in base portions 54, 60 and bracing member 16, the clamps may be firmly secured about the bracing member 16 by wing nuts 66. This is best shown in FIGS. 2 and 4.

As shown in FIG. 5, the base portions 54, 60 are so dimensioned that when they are disposed in confronting relation about the bracing member 16, their confronting edges on the window facing side of the bracing member 16 will be in close spaced ralation. This insures that bracing member 16 will be firmly held between the clamps 52, 58.

As is best shown in FIGS. 2–4, the protruding portion 56 includes a tapered inner portion 68 and an outer portion 70. Protruding portion 62, being a mirror image of the portion 56 likewise includes a tapered inner portion 72 and an outer portion 74. As shown, to permit swiveling of the supporting member 40 in the joint 50 as will be more fully explained hereinafter, the inner tapered portions 68, 72 are bulged outwardly from the member 40. For the same reason, the protruding portions 56, 72 are so dimensioned that when clamped about the supporting member 40 one set of confronting edges 73 will be in relatively close spaced relation (FIG. 3) while the other set of confronting edges 75 will be in greater spaced relation (FIG. 2).

As illustrated, the cross sections of outer portions 70, 74 are curved and have internal radii substantially equal to the outer diameter of the supporting member 40 whereby member 40 may be received in close tolerance between said outer portions. Taken together, the outer portions 70, 74, when clamped about the supporting member 40, define the second sleeve for holding the member 40 firmly in place. The sleeve also serves to distribute the load of the member 40 on joint 50 thereby reducing the possibility of fatique at any given point.

Spaced from the base portion 54 and substantially at the center of the tapered inner portion 68 is a hole 69*a*. A corresponding hole 69*b* is located at the same location in the tapered inner portion 72. In addition, a first thru-hole 77 is provided in the member 40 such that when the clamps 52, 58 are secured in place, the holes in the inner portions 68, 72 will be registered with the first thru-hole 77 in the member 40.

As shown, outer portions 70, 74 are provided with swivel slots 76, 78, respectively. As illustrated, the slots 76, 78 are open-ended and extend inwardly from the confronting edges 75 and terminate approximately at the center lines of the outer portions 70, 74. A second thru-hole 79 is provided in the supporting member 40 such that when the joint 50 is in place and member 40 is in the extended position, the second thru-hole 79 is registered with the innermost portions of the slots 76, 78.

As presently preferred and shown, clamping of the supporting member 40 between the protruding portions 56, 62 may then be effected by threaded bolts 80 and wing nuts 82. Thus, with bolt 80*a* extended through the registered holes in the inner portions 68, 72 and the first thru-hole 77 in supporting member 40, and with bolt 80*b* extended through slots 76, 78 and the second thru-hole 79 in the member 40, the protruding portions 56, 62 may be secured about the member 40 by the wing nuts 82. As will be apparent to the skilled art worker, the diameter of the clamping face of the wing nut 82*b* should be greater than the width of the slot 76 to effect proper clamping of the supporting member 40 when the member 40 is in the extended position (FIG. 2). Preferably, and as shown, this is accomplished by disposing a flat washer 83 between wing nut 82*b* and protruding portion 56. For the same reason, an additional flat washer (not shown) is preferably disposed between the head of bolt 80*b* and protruding portion 62.

Because the juncture of the bracing member 16 and the supporting member 40 are substantially completely encompassed by swivel joint 50, and because the clamps 52, 58 are secured to the bracing member 16 by bolts which extend both through the clamps and the bracing member 16, swivel joint 50 provides excellent structural support for supporting member 40.

Referring now to FIG. 4 the supporting member 40 is shown in the swivel position in which the supporting member 40 is drawn close to the bracing member 16 in order that adjustment at the free end of the supporting member 40, such as, for example, adjustments in the orientation of the ground plane elements 22 in FIG. 1 or removal of the antenna 14 may be effected.

In order to effect movement of the member 40 to the swivel position, all that is necessary is that wing nuts 82 be loosened. Loosening of the wing nuts 82 allows the confronting edges 75 to be separated a distance at least equal to the outer diameter of the supporting member 40, and permits bolt 80*b* to be moved out of swivel slots 76, 78. Member 40 may then be rotated about the bolt 80*a* whereby the supporting member 40 may be moved to the swivel position illustrated in FIG. 4. Clearly, as the member 40 is being moved to the swivel position, the rear end of the member 40 is also being moved. Thus, the bulge between the confronting edges 73 (FIG. 3) accommodates protrusion of the rear end therethrough when the member 40 is in the swivel position. Preferably and as shown, the bulge is provided by humps in the protruding portions adjacent the base portions.

In order to return the member 40 to the extended position, one need only move the member 40 back between the protruding portions 56, 62 and tighten the wing nut 82.

Assembly of the clamp 50 about the bracing member 16 and the supporting member 40 is simple. Preferably, this is accomplished by first securing the base portions 54, 60 about the bracing member 16 by the bolts 64 and wing nuts 66. Once this is done, the supporting member 40 is inserted betwen the protruding portions 56, 62. The position of the supporting member 40 is then adjusted until the holes in the member 40 are aligned with the holes and slots in the portions 56, 62. The bolts 80 are then inserted in place and secured by the wing nuts 82.

While with reference to FIGS. 2–5 we have now described the preferred embodiment of the swivel joint according to the present invention, it will be readily apparent to those skilled in the art that various changes and modifications may be made therein without departing from the spirit and scope of this invention. For example, in the event the clamp is to be employed with noncircular members, it will be obvious that the cross sections of the base portions 54, 60 and the protruding portions 56, 62 of the clamps may be varied accordingly. Further, while two bolts 64 are employed in the preferred embodiment to secure the base portions to the bracing member, it is deemed obvious that additional bolts may be employed. While it is also possible to eliminate one of the bolts 64 this is not preferred inasmuch as it reduces the structural integrity of the joint 50. Also, it is possible to make the bolts 64 and/or the bolts 80 part of the members 16 and 40, respectively. In such event, the procedure described above for assembling the joint 50 would have to be modified.

Moreover, the slot in the top clamp 52 or, alternatively, the slot in the bottom clamp 58 may be eliminated. If one of the slots is eliminated, it is apparent that bolt 89*b* need no longer extend through the member 40. Thus, the thru-hole in member 40 registerable with the slots could be replaced, for example, by a threaded blind hole registerable with the remaining slot. In such case the head of the bolt could replace the wing nut 82 or, alternatively, a headless bolt could be used in which case the wing nut-washer arrangement described above could be employed.

In addition, while the holes in the protruding portions are shown disposed behind the slots, the position of the slots and holes could be reversed. If this arrangement is employed, the bulge would have to be lengthened to accommodate the additional movement of the rear end of the supporting member that would accompany movement of said member to the swivel position.

Further, rather than employing a bulge, the inner portions 68, 72 on the side of confronting edges 73 could be cut away whereby the space between the confronting edges 73 at that location would be sufficiently spaced to permit movement of the end portion of the supporting member 40 therethrough. Also, while it is preferred that the length of the base portions be greater than the diameter of the supporting member, this is not necessary.

While the swivel joint 50 has been described for use in conjunction with a window mounted assembly for supporting a vertical CB antenna, it is deemed obvious that other antennas may be supported by the member 40. Thus, for example, the joint 50 may be employed with a window assembly for supporting a TV antenna outside of a window.

Since these and other changes and modifications are within the scope of the present invention, the above description is to be construed as illustrative, and not in the limiting sense.

What is claimed is:

1. In an antenna window mount assembly of the type including a bracing member adapted to be secured within the frame of a window; a supporting member; and means for securing one end of the supporting member to the bracing member to secure said supporting member in outwardly extending relation from the window, the free end of said supporting member being adapted to be connected to an antenna; the improvement comprising a swivel joint for releasably securing the supporting member to the bracing member to permit said supporting member to be moved between said outwardly extending position and a swivel position in which the free end of said supporting member is in relatively close spaced relation with the window, said swivel joint comprising:

a pair of T-shaped clamps each including a base portion and a protruding portion, said clamps being disposed in spaced confronting relation to define a first sleeve between said base portions in which said bracing member is disposed, and a second sleeve between said protruding portions in which said one end of said supporting member is disposed;

means for removably securing said base portions to said bracing member;

each of said protruding portions having a hole therein, said one end of said supporting member having a thru-hole therein, said protruding portion holes being in register with said thru-hole; first bolt means extending through said registered holes for pivotally mounting said supporting member on said bracing member for movement between said outwardly extending position in which said supporting member is coaxial with said second sleeve and said swivel position in which said supporting member is non-coaxial with said second sleeve; first nut means for engaging said first bolt means and securing said supporting member in said second sleeve;

at least one of said protruding portions having a first slot extending inwardly from an axially extending edge thereof, said one end of said supporting member having an additional hole therein, said first slot being registerable with said additional hole when said supporting member is coaxial with said second sleeve; second bolt means extendable through said first slot and said additional hole when said first slot and said additional hole are registered; second nut means for engaging said second bolt means for releasably securing said supporting member in said coaxial position, the loosening of said first and second nut and bolt means permitting said second bolt means to be disengaged from said first slot, and allowing said protruding portions to be sufficiently separated to accommodate movement of said supporting member between said protruding portions toward said non-coaxial position.

2. The improved swivel joint of claim 1, wherein the other of said protruding portions has a second slot extending inward from the axially extending edge thereof confronting said first mentioned axially extending edge, said second slot being in register with said first slot; and wherein said additional hole in said supporting member is an additional thru-hole, and said second bolt means is extendable through said first and second slots and said additional thru-hole when said supporting member is in said coaxial position.

3. The swivel joint of claim 1, wherein said bracing member is provided with two thru-holes and wherein each of said base portions has a pair of holes therein, said last mentioned pairs of holes being in register with each other, said registered pairs of holes also being in register with said two thru-holes in said bracing member; and further comprising third bolt means extending through said pairs of holes and said two base member thru-holes; and third nut means engaging said third bolt means for releasably securing said bracing member in said first sleeve.

4. The improved swivel joint of claim 1, wherein said protruding portions each have a humped portion adjacent said base portion, said humped portions protruding outwardly from the axis of said second sleeve for defining an enlarged space for receiving said one end of said supporting member when said supporting member is in said non-coaxial position.

5. The swivel joint of claim 4, wherein a portion of said protruding portions are unhumped and wherein said axially extending edge of said one protruding portion along the unhumped portion thereof, and the confronting axially extending edge of the other protruding portion are in relatively large spaced relation as compared with the other confronting axially extending edges of said protruding portions.

6. The swivel joint of claim 1, wherein said first and second sleeves are substantially cylindrically shaped for receiving cylindrical tubular bracing and supporting members.

7. The swivel joint of claim 1, wherein said lengths of said base portions are greater than the widths of the free ends of their respective protruding portions.

8. The swivel joint of claim 7, wherein each of said protruding portions includes a portion tapered inwardly from the ends of said base portions, whereby to provide greater load distribution at the interfaces of said base portions with their respective protruding portions.

9. The swivel joint of claim 1, wherein said pair of T-shaped clamps are of substantially identical dimensions.

* * * * *

UNITED STATES PATENT OFFICE

CERTIFICATE OF CORRECTION

Patent No. 4,104,642 Dated Aug. 1, 1978

Inventor(s) Gilbert Padilla; Dominick Padilla

It is certified that error appears in the above-identified patent and that said Letters Patent are hereby corrected as shown below:

Column 6, Line 40: " bolt 89b " should read

-- bolt 80b --

Signed and Sealed this

*Twenty-seventh* Day of *February 1979*

[SEAL]

*Attest:*

RUTH C. MASON
*Attesting Officer*

DONALD W. BANNER
*Commissioner of Patents and Trademarks*